US011075020B2

(12) United States Patent
Otsuka et al.

(10) Patent No.: US 11,075,020 B2
(45) Date of Patent: Jul. 27, 2021

(54) ALUMINUM BASED COMPOSITE MATERIAL, ELECTRIC WIRE USING THE SAME, AND MANUFACTURING METHOD OF ALUMINUM BASED COMPOSITE MATERIAL

(71) Applicant: Yazaki Corporation, Tokyo (JP)

(72) Inventors: Yasufumi Otsuka, Shizuoka (JP); Satoru Yoshinaga, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 111 days.

(21) Appl. No.: 16/163,825

(22) Filed: Oct. 18, 2018

(65) Prior Publication Data

US 2019/0122783 A1 Apr. 25, 2019

(30) Foreign Application Priority Data

Oct. 20, 2017 (JP) ..... JP2017-203551

(51) Int. Cl.
*H01B 1/02* (2006.01)
*H01B 1/04* (2006.01)
(Continued)

(52) U.S. Cl.
CPC ..... *H01B 1/02* (2013.01); *B22F 3/1039* (2013.01); *B22F 3/16* (2013.01); *C22C 1/0416* (2013.01);
(Continued)

(58) Field of Classification Search
CPC .. H01B 1/02; H01B 1/023; H01B 1/04; C22C 21/00; C22C 26/00; C22C 2026/002;
(Continued)

(56) References Cited

U.S. PATENT DOCUMENTS 4,834,942 A * 5/1989 Frazier ..... C22C 1/002 148/437
5,632,827 A * 5/1997 Fujita ..... C22C 32/0047 148/415
(Continued)

FOREIGN PATENT DOCUMENTS

CN 107058811 A * 8/2017
CN 107142398 A * 9/2017
(Continued)

OTHER PUBLICATIONS

English machine translation of Duan et al. (CN 107058811 A). (Year: 2017).*
(Continued)

*Primary Examiner* — Matthew R Diaz
(74) *Attorney, Agent, or Firm* — Sughrue Mion, PLLC

(57) ABSTRACT

An aluminum based composite material includes an aluminum parent phase and dispersions dispersed in the aluminum parent phase and formed such that a portion or all of additives react with aluminum in the aluminum parent phase, an average particle diameter of the dispersions is 20 nm or less, a content of the dispersions is 0.25% by mass or more and 0.72% by mass or less in terms of carbon amount, and an interval between the dispersions adjacent to each other is 210 nm or less.

5 Claims, 5 Drawing Sheets

(51) Int. Cl.

| | |
|---|---|
| ***B22F 3/16*** | (2006.01) |
| ***B22F 3/10*** | (2006.01) |
| ***C22C 32/00*** | (2006.01) |
| ***C22C 1/04*** | (2006.01) |
| ***C22C 21/00*** | (2006.01) |
| ***C22C 1/05*** | (2006.01) |
| *C22C 26/00* | (2006.01) |

(52) U.S. Cl.
CPC ..... *C22C 1/058* (2013.01); *C22C 21/00* (2013.01); *C22C 32/0047* (2013.01); *H01B 1/023* (2013.01); *H01B 1/04* (2013.01); *B22F 2301/052* (2013.01); *B22F 2302/403* (2013.01); *C22C 26/00* (2013.01); *C22C 32/0057* (2013.01); *C22C 32/0084* (2013.01); *C22C 2026/002* (2013.01)

(58) Field of Classification Search
CPC ..... C22C 2026/003; C22C 2026/006; C22C 2026/008; C22C 32/0047; C22C 32/0057; C22C 32/0084; C22C 1/0415; C22C 1/058; C22C 2026/007; C22C 32/0052; B22F 3/1039; B22F 3/16; B22F 2301/052; B22F 2302/403
See application file for complete search history.

(56) References Cited

U.S. PATENT DOCUMENTS

| | | | | |
|---|---|---|---|---|
| 2009/0162654 | A1 | 6/2009 | So et al. | |
| 2012/0241670 | A1* | 9/2012 | Bae | C22C 1/1084 252/182.35 |
| 2017/0073797 | A1* | 3/2017 | Otsuka | H01B 1/023 |
| 2017/0120340 | A1* | 5/2017 | Kondoh | C22C 32/0057 |

FOREIGN PATENT DOCUMENTS

| | | | | |
|---|---|---|---|---|
| JP | 5296438 | B2 | 9/2013 | |
| JP | 2015-227498 | A | 12/2015 | |
| JP | 2015227498 | A * | 12/2015 | B22F 7/008 |

OTHER PUBLICATIONS

English machine translation of Ji et al. (CN 107142398 A). (Year: 2017).*

* cited by examiner

ALUMINUM BASED COMPOSITE MATERIAL, ELECTRIC WIRE USING THE SAME, AND MANUFACTURING METHOD OF ALUMINUM BASED COMPOSITE MATERIAL

CROSS REFERENCE TO RELATED APPLICATION

This application is based upon and claims the benefit of priority from the prior Japanese Patent Application No. 2017-203551, filed on Oct. 20, 2017, the entire contents of which are incorporated herein by reference.

BACKGROUND

1. Technical Field

The present invention relates to an aluminum based composite material, an electric wire using the same, and a manufacturing method of the aluminum based composite material. More specifically, the present invention relates to an aluminum based composite material having high strength and good conductivity, a wire using the same, and a manufacturing method of the aluminum based composite material.

2. Background Art

Copper has been mainly used as a conductor material for electric wires and the like used in a wire harness for automobiles, but aluminum has attracted attention as a result of the requirement for weight reduction of conductors. However, though aluminum is lightweight, there remains the problem that strength and conductivity are low as compared with copper. Therefore, methods for improving strength and conductivity by combining aluminum with other materials have been studied.

Japanese Patent No. 5296438 describes a method of producing an aluminum-carbon material composite including a process of treating a carbon material in an acidic solution with ultrasonic waves and a process of mixing the obtained carbon material with aluminum.

Further, the method of producing the aluminum-carbon material composite in Japanese Patent No. 5296438 describes that a process of encapsulating the carbon material in aluminum by ball milling the obtained mixture under an inert gas atmosphere is included. Then, in Japanese Patent No. 5296438, it is described that carbon nanotubes are used as the carbon material, and the carbon nanotubes are treated with nitric acid in order to make the carbon nanotubes functional.

SUMMARY

However, in Japanese Patent No. 5296438, it is aimed to maintain the crystallinity of the carbon nanotubes without destroying the structure thereof, and there is a possibility that the carbon nanotubes are not finely dispersed. In addition, in Japanese Patent No. 5296438, the amount of addition of carbon nanotubes is as large as 5% by weight, and there is a possibility that carbon nanotubes aggregate in aluminum. Therefore, even if carbon nanotubes are added, there is a possibility that the strength of the aluminum-carbon material composite is not sufficiently strengthened and the conductivity decreases.

The present invention has been made in view of such problems of conventional technology. An object of the present invention is to provide an aluminum based composite material having high strength and good conductivity, an electric wire using the same, and a manufacturing method of the aluminum based composite material.

An aluminum based composite material according to a first aspect of the present invention includes an aluminum parent phase and dispersions dispersed in the aluminum parent phase and formed such that a portion or all of additives react with aluminum in the aluminum parent phase, an average particle diameter of the dispersions is 20 nm or less, a content of the dispersions is 0.25% by mass or more and 0.72% by mass or less in terms of carbon amount, and an interval between the dispersions adjacent to each other is 210 nm or less.

An aluminum based composite material according to a second aspect of the present invention relates to the aluminum based composite material according to the first aspect, wherein the additives are at least one selected from the group consisting of carbon nanotubes, carbon nanohorns, carbon black, boron carbide, and boron nitride.

An electric wire according to a third aspect of the present invention includes the aluminum based composite material according to the first or second aspect.

A manufacturing method of an aluminum based composite material according to a fourth aspect of the present invention is a manufacturing method of the aluminum based composite material according to the first or second aspect and includes mixing an aluminum powder having purity of 99% by mass or more with the additives to obtain a mixed powder in which an interval between the additives adjacent to each other is 300 nm or less, preparing a green compact by compacting the mixed powder, and heating the green compact at a temperature of 600 to 660° C. to react a portion or all of the additives with aluminum in the aluminum powder, so as to disperse the dispersions formed of aluminum carbide inside the aluminum parent phase.

According to the present invention, an aluminum based composite material having high strength and good conductivity, an electric wire using the same, and a manufacturing method of the aluminum based composite material can be provided.

DETAILED DESCRIPTION

Figure 1:
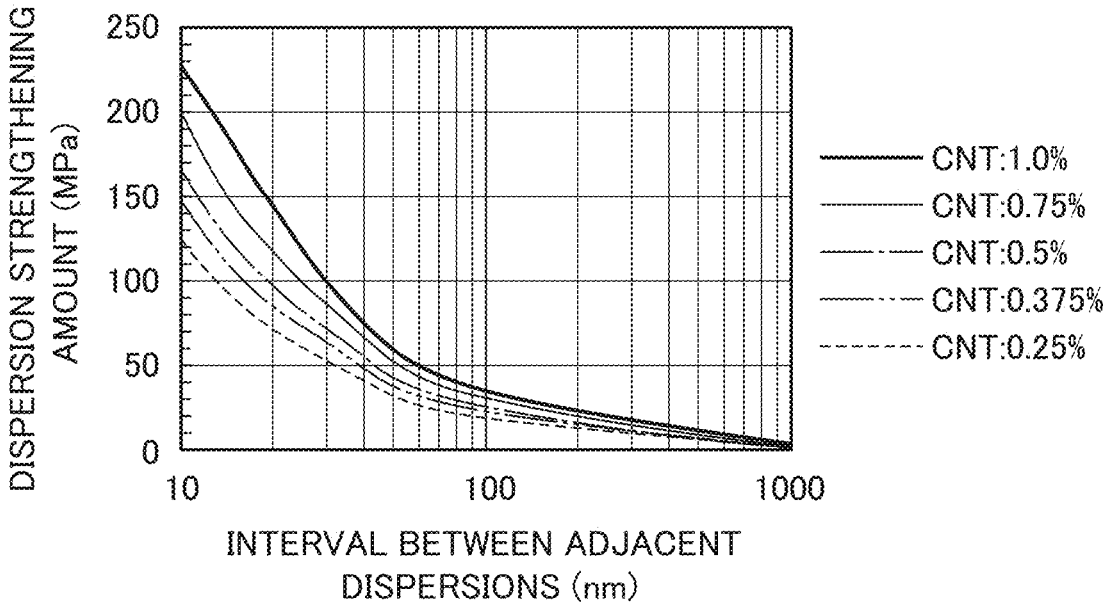
FIG. 1 is a graph showing a relationship between an amount of addition of carbon nanotubes and an amount of reinforcement of tensile strength of an aluminum based composite material by adding carbon nanotubes.

Hereinafter, an aluminum based composite material according to an embodiment of the present invention, an electric wire using the same, and a manufacturing method of the aluminum based composite material will be described in detail with reference to the drawings. The dimensional ratios in the drawings are exaggerated for convenience of explanation and may differ from the actual ratio.

[Aluminum Based Composite Material]

An aluminum based composite material according to the present embodiment includes an aluminum parent phase and dispersions dispersed in the aluminum parent phase and formed such that a portion or all of additives react with aluminum in the aluminum parent phase.

A pure aluminum material prepared by a conventional melt process had a tensile strength of only about 85 MPa. Further, even if carbon is added to increase the strength, carbon has poor wettability with aluminum and so it is difficult to disperse carbon uniformly in aluminum. Thus, even if such a conventional aluminum material is used, it is difficult to suppress stress relaxation in a high-temperature environment.

In contrast, in an aluminum based composite material according to the present embodiment, the dispersions are highly dispersed inside the aluminum parent phase and the crystal grains of aluminum are refined. In this way, it is possible to increase the strength by using an aluminum based composite material in which a solidification structure of aluminum is made fine and uniform.

As the aluminum parent phase in an aluminum based composite material, aluminum having the purity of 99% by mass or more is preferably used. As for the aluminum parent phase, it is also preferable to use, among unalloyed aluminum ingots specified in Japanese Industrial Standards JIS H 2102 (aluminum ingots for remelting), aluminum ingots of the purity of Type 1 aluminum ingots or more. More specifically, Type 1 aluminum ingots having the purity of 99.7% by mass, Special Type 2 aluminum ingots having the purity of 99.85% by mass or more, and Special Type 1 aluminum ingots having the purity of 99.90% by mass or more can be cited. By using such aluminum as the aluminum parent phase, the conductivity of the obtained aluminum based composite material can be improved.

Incidentally, the aluminum parent phase may contain inevitable impurities mixed in raw materials and at the manufacturing stage. Examples of inevitable impurities that may be contained in the aluminum parent phase include zinc (Zn), nickel (Ni), manganese (Mn), rubidium (Rb), chromium (Cr), titanium (Ti), tin (Sn) vanadium (V), gallium (Ga), boron (B), sodium (Na) and the like. These impurities do not inhibit the effect of the present embodiment and are inevitably contained within a range that does not significantly affect the characteristics of the aluminum based composite material according to the present embodiment. Elements previously contained in the aluminum ingots to be used are also included in the inevitable impurities mentioned here. The total amount of inevitable impurities in the aluminum based composite material is preferably 0.07% by mass or less, more preferably 0.05% by mass or less.

In the aluminum based composite material according to the present embodiment, the dispersions formed by the reaction between aluminum and additives is highly dispersed inside the aluminum parent phase. That is, the dispersions are formed by the bonding of additives to aluminum in the aluminum parent phase by sintering. Such additives are not particularly limited, but are preferably at least one selected from the group consisting of carbon nanotubes, carbon nanohorns, carbon black, boron carbide ($B_4C$) and boron nitride (BN). Such additives readily react with aluminum and thus, crystal grains of aluminum can be refined.

The shape of the dispersion dispersed in the aluminum parent phase is not particularly limited, but the shape of the dispersion is preferably rod-like or needle-like. With the dispersion being rod-like or needle-like, the dispersibility inside the aluminum parent phase is improved so that the crystal grains of the aluminum based composite material can be further refined. When the dispersion is rod-like or needle-like, the ratio of the length (L) to the diameter (D) is preferably: length (L)/diameter (D)=1 to 30. In addition, the length (L) is preferably 0.01 nm to 500 nm, and the diameter (D) is preferably 0.01 nm to 200 nm. By setting the length and the diameter of the dispersion within the above ranges, the tensile strength by the dispersion being dispersed in the aluminum parent phase can be sufficiently improved. The length and diameter of the dispersion can be measured by observing the cross section of the aluminum based composite material under an electron microscope.

The average particle diameter of the dispersions dispersed in the aluminum parent phase is 20 nm or less. By setting the average particle diameter of the dispersions to 20 nm or less, the strength of the aluminum based composite material due to dispersion of carbon nanotubes can be improved. The lower limit of the average particle diameter of the dispersions dispersed in the aluminum parent phase is not particularly limited, but is generally 0.4 nm or more. From the viewpoint of improving the strength, the average particle diameter of the dispersions dispersed in the aluminum parent phase is 10 nm or less. The average particle diameter (D50) of the dispersions represents the particle size when the cumulative value of the grain size distribution on a volume basis is 50%, and can be measured by, for example, a laser diffraction/scattering method. The average particle diameter of the dispersions can also be determined by, for example, averaging particle sizes measured by observation under an electron microscope.

In the aluminum based composite material according to the present embodiment, it is more preferable that the dispersion made of rod-like or needle-like aluminum carbide ($Al_4C_3$) is highly dispersed inside the aluminum parent phase. Note that the aluminum carbide is formed by a rod-like or needle-like carbon material being bonded with aluminum in the aluminum parent phase by sintering. As such a carbon material, at least one selected from the group consisting of carbon nanotubes, carbon nanohorns, and carbon nanofibers can be used. Among these, carbon nanotubes are particularly preferable as the carbon material.

Known carbon nanotubes can be used. Carbon nanotubes may be preliminarily washed with an acid to remove a metal catalyst such as platinum or amorphous carbon, or graphitized by high-temperature treatment in advance. When such carbon nanotubes are subjected to such pretreatment, carbon nanotubes can be highly purified or highly crystallized.

Rod-like or needle-like aluminum carbide dispersed in the aluminum parent phase is formed by the reaction of the above-described carbon material and aluminum in the aluminum parent phase. Here, a portion or all of the carbon materials such as carbon nanotubes have reacted with aluminum in the aluminum parent phase. In the present embodiment, it is most preferable that all of the additive carbon materials react with aluminum in the aluminum parent phase to change the composition thereof to aluminum carbide. However, for example, when a spherically aggregated portion of carbon nanotubes remains in the aluminum parent phase, the carbon nanotubes inside the aggregation are not in contact with the aluminum parent phase. Therefore, there is a possibility that carbon nanotubes remain as they are in the aluminum parent phase. However, from the viewpoint of improving the strength of the aluminum based composite material, 95% by mass or more of the additive carbon material has preferably reacted with aluminum in the aluminum parent phase and more preferably, 98% by mass or more of the carbon material has reacted with aluminum in the aluminum parent phase. It is particularly preferable that all of the additive carbon materials have reacted with aluminum in the aluminum parent phase.

In addition, in the aluminum based composite material, the interval between adjacent dispersions is 210 nm or less. By having the dispersion interval of 210 nm or less, the dispersibility of the dispersions inside the aluminum parent phase can be increased and also the aluminum grain can be made fine and so, the strength of the aluminum based composite material can be improved. In the aluminum based composite material, the interval between adjacent dispersions is preferably 200 nm or less.

The interval between adjacent dispersions can be determined by observing the cross section of the aluminum based composite material under an electron microscope and directly measuring and averaging the intervals. Also, the interval between adjacent dispersions can be calculated by observing the cross section of the aluminum based composite material under an electron microscope and substituting the number of dispersions per unit area into the following formula (1).

[Math 1]

$$a = \sqrt{\frac{2}{\sigma\sqrt{3}}} \tag{1}$$

In the above formula (1), a represents the interval (μm) between adjacent dispersions and σ represents the number of dispersions per unit area (number/$\mu m^2$) in the aluminum based composite material.

In the aluminum based composite material according to the present embodiment, the content of the dispersions is 0.25% by mass or more and 0.72% by mass or less in terms of carbon amount. By setting the content of the dispersions to 0.25% by mass or more, sufficient tensile strength can be obtained. Also, by setting the content of the dispersions to 0.72% by mass or less, sufficient conductivity can be obtained. From the viewpoint of tensile strength, the content of the dispersions in the aluminum based composite material is more preferably 0.50% by mass or less in terms of carbon amount. Also, from the viewpoint of conductivity, the content of the dispersions in the aluminum based composite material is more preferably 0.35% by mass or more in terms of carbon amount.

FIG. 1 shows the relationship between the content of carbon nanotubes (CNT) contained in the aluminum based composite material and the contribution of tensile strength (dispersion strengthening amount) obtained by dispersing additives of the aluminum based composite material. In FIG. 1, the x axis represents the interval (nm) between adjacent dispersions and the y axis represents the dispersion strengthening amount (MPa). As shown in FIG. 1, with an increasing amount of carbon in the aluminum based composite material, the dispersion strengthening amount tends to increase.

The dispersion strengthening amount can be calculated by the expression of Orowan-Ashby model expressed in the following formula (2):

[Math 2]

$$\Delta\sigma_D = \frac{MGb}{2.36\pi} \cdot \ln\left(\frac{r_0}{b}\right) \cdot \frac{1}{x} \tag{2}$$

In the above formula (2), $\Delta\sigma_D$ is a dispersion strengthening amount (MPa), M is a Taylor factor (no unit), G is a modulus of rigidity (MPa), b is a Burgers vector (nm), $r_0$ is the average particle diameter (nm), and x is the interval (nm) between adjacent dispersions.

Also, in the above formula (2), the interval x between adjacent dispersions can be expressed by the following formula (3):

[Math 3]

$$x = r_0\left(\sqrt[3]{\frac{4\pi}{3f_v}} - 2\right) \tag{3}$$

In the above formula (3), $r_0$ is the average particle diameter (nm) of the dispersions and $f_v$ is the content (mass ratio) of the dispersions.

Figure 2:
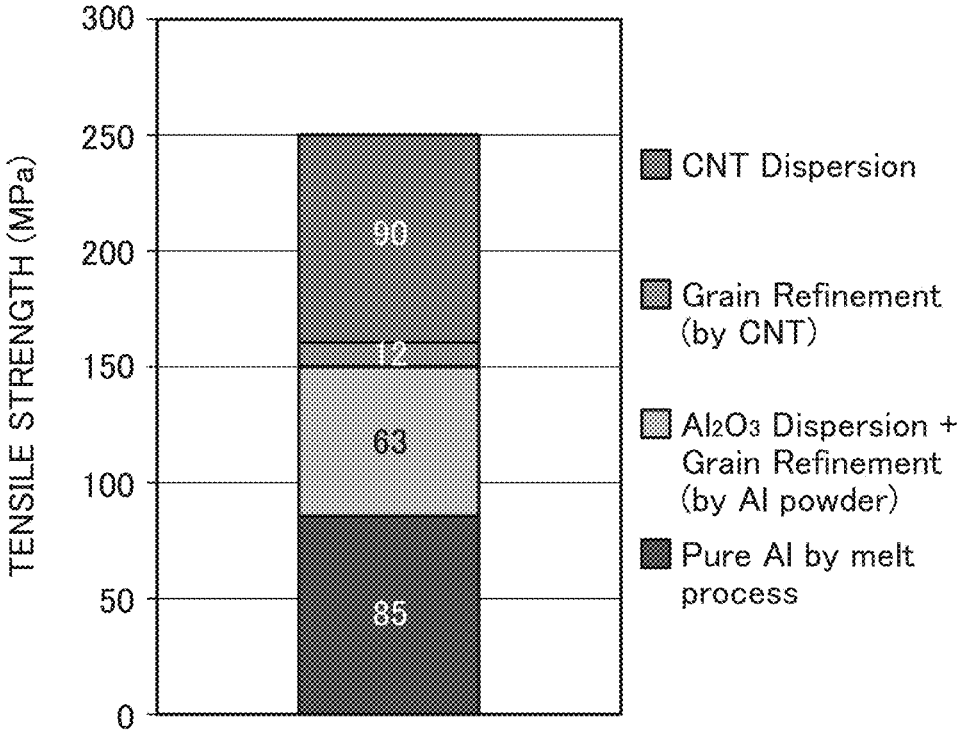
FIG. 2 is a bar graph showing a contribution of reinforcement of tensile strength to pure aluminum formed by a melt process.

Here, as shown in FIG. 2, the tensile strength of pure aluminum formed by the melt process is 85 MPa. Then, the contribution to tensile strength by oxide dispersions and grain refinement by powder metallurgy is 63 MPa and the contribution to tensile strength by grain refinement of carbon nanotubes is 12 MPa. Thus, in order to make the tensile strength in the aluminum based composite material equal to that of pure copper, which is 250 MPa, it is necessary to strengthen the tensile strength of 90 MPa, which is the difference therebetween, by dispersing additives in the aluminum parent phase. Therefore, in order to make the tensile strength of the aluminum based composite material according to the present embodiment equal to that of pure copper, it is necessary from FIG. 1 to set the content of the dispersions to 0.25% by mass or more in terms of carbon amount. Incidentally, the tensile strength value in this specification can be measured in accordance with JIS Z 2241 (metal materials-tensile testing-Method of test at room temperature).

Figure 3:
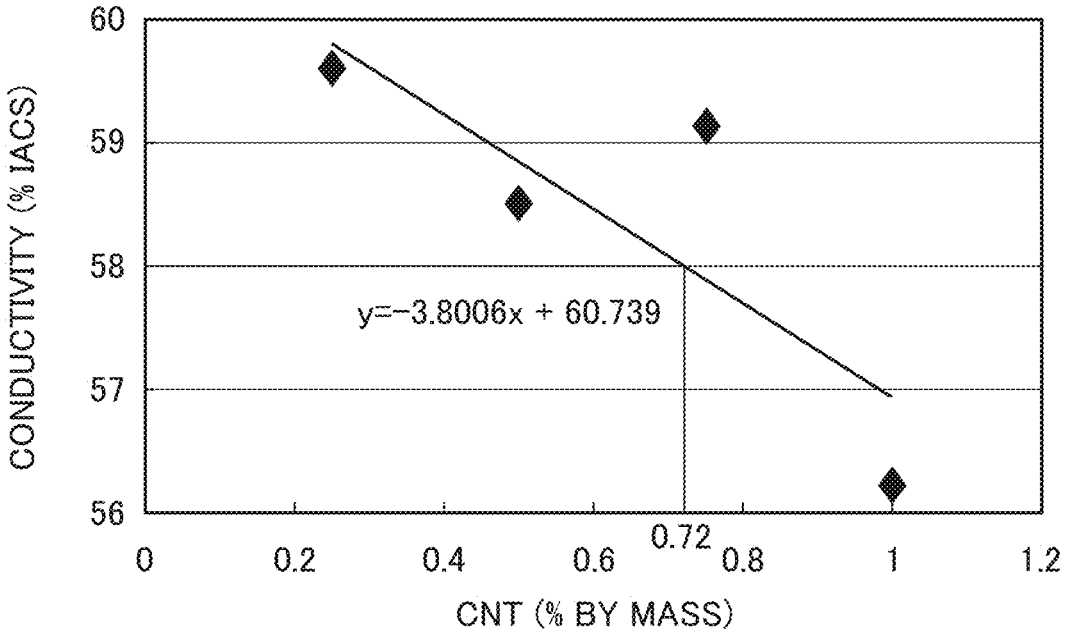
FIG. 3 is a graph showing the relationship between carbon nanotube content (in terms of carbon amount) and conductivity in an aluminum based composite material according to the present embodiment.

On the other hand, FIG. 3 shows the relationship between the content of carbon nanotubes (CNT) contained in the aluminum based composite material and the conductivity of the aluminum based composite material. As shown in FIG. 3, there is a linear-functional correlation between the carbon nanotube as an additive and the conductivity. That is, the conductivity decreases with an increasing amount of carbon in the aluminum based composite material.

Here, according to JASO D 603, it is required to set the conductivity to 58% IACS or more. Therefore, in order to set the conductivity of the aluminum based composite material according to the present embodiment to 58% IACS or more, it is required from FIG. 3 to set the content of the dispersions to 0.72% by mass or less in terms of carbon amount. When the content of the dispersions is set to 0.25% by mass or more and 0.72% by mass or less in terms of carbon amount, in terms of the content of aluminum carbide, the above content is approximately 0.99% by mass or more and 2.85% by mass or less. Further, the conductivity value in this specification can be measured in accordance with JIS H 0505 (Measuring Methods for Electrical Resistivity and Conductivity of Non-Ferrous Materials).

In the aluminum based composite material according to the present embodiment, the crystal grain size of the aluminum parent phase is preferably 2 μm or less. With the crystal grain size of the aluminum parent phase being refined up to 2 μm or less, the strength and toughness of the aluminum based composite material can be increased. The crystal grain size of the aluminum parent phase can be determined by an average grain intercept method.

As described above, the aluminum based composite material in the present embodiment includes an aluminum parent phase and dispersions dispersed in the aluminum parent phase and formed such that a portion or all of additives react with aluminum in the aluminum parent phase. In the aluminum based composite material, the average particle diameter of the dispersions is 20 nm or less, the content of the dispersions is 0.25% by mass or more and 0.72% by mass or less in terms of carbon amount, and the interval between dispersions adjacent to each other is 210 nm or less.

Thus, with nano-sized dispersions being highly dispersed uniformly in the aluminum parent phase without aggregation, the strength of the aluminum based composite material can be increased to a level equal to that of copper to refine aluminum grains. Also, since the dispersions in the aluminum based composite material are nano-sized and uniformly dispersed, the conductivity is not significantly lower than that of pure aluminum. Consequently, conductive members such as bus bars, conductors and terminals using the aluminum based composite material have high conductivity and can be used even under high temperature environments.

[Electric Wire]

An electric wire according to the present embodiment includes the above aluminum based composite material. The aluminum based composite material of the present embodiment has, as described above, high strength and conductivity and so can be used as a conductor of electric wire by wire drawing. The electric wire according to the present embodiment may be an electric wire including a conductor (for example, a stranded wire) including an element wire made of the aluminum based composite material and a coating layer provided on the outer circumference of the conductor. Therefore, other specific configurations, shapes, and manufacturing methods are not limited at all.

The shape and the like of element wires constituting a conductor are also not particularly limited. For example, when the element wire is a round wire and is used for an electric wire for automobiles, the diameter (that is, the final wire diameter) is preferably about 0.07 mm to 1.5 mm and more preferably about 0.14 mm to 0.5 mm.

As the type of resin used for the coating layer, an olefin resin such as crosslinked polyethylene, polypropylene or the like, or a known insulating resin such as vinyl chloride can be optionally used. Further, the thickness of the coating layer can be determined as appropriate. This electric wire can be used for various applications such as electric or electronic components, mechanical components, components for vehicles, building materials, etc., but can be preferably used as an electric wire for automobiles in particular.

Incidentally, the electric wire using the aluminum based composite material in the present embodiment as a conductor may be solid-phase bonded to an electric wire using a conductor made of another metallic material in a cold state. In order to facilitate connection to an electronic device, a terminal metal fitting may be crimp-connected to a conductor made of an aluminum based composite material.

[Manufacturing Method of Aluminum Based Composite Material]

Figure 4:
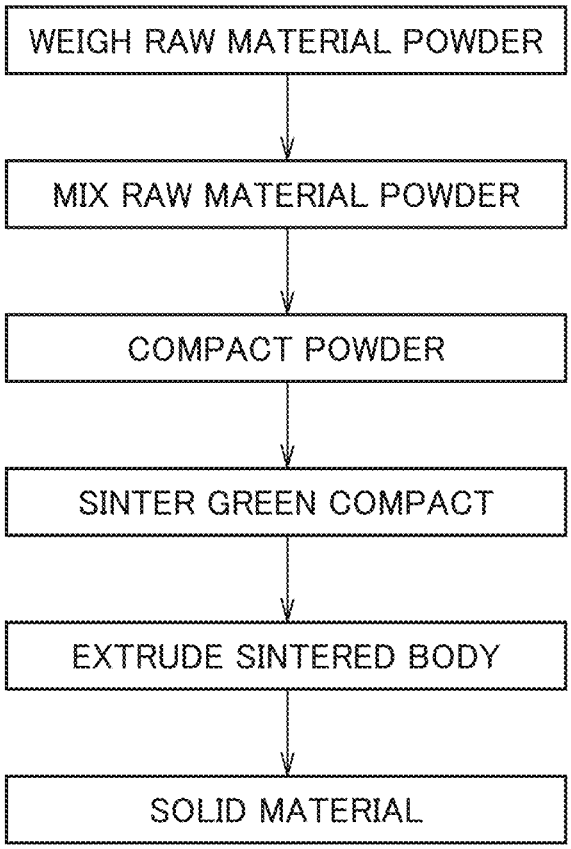
FIG. 4 is a flowchart showing a manufacturing method of the aluminum based composite material according to this embodiment.

Next, a manufacturing method of the above aluminum based composite material will be described. As shown in FIG. 4, first, aluminum powder as a raw material of the aluminum based composite material and additives are weighed. As for the aluminum powder, as described above, it is preferable to use aluminum having the purity of 99% by mass or more to improve conductivity. As the additive, as described above, it is preferable to use, for example, carbon nanotubes, carbon nanohorns, carbon black, boron carbide ($B_4C$), boron nitride (BN) or the like.

In the weighing process, the aluminum powder and additives are weighed so that the content of the dispersions in the obtained aluminum based composite material is 0.25% by mass or more and 0.72% by mass or less in terms of carbon amount.

Then, the weighed aluminum powder and additives are mixed to prepare a mixed powder. A method of mixing the aluminum powder and additives is not particularly limited, and the aluminum powder and additives can be mixed by at least one of a dry method by milling and a wet method by which alcohol is used for mixing.

In the mixed powder, it is preferable that the interval between additives adjacent to each other is 300 nm or less. By setting the interval between the additives adjacent to each other to 300 nm or less, the interval between the dispersions adjacent to each other can be made 210 nm or less in the following compression molding.

The interval between additives adjacent to each other can be prepared by controlling the mixing method. For example, in the case of mixing by milling, the interval between additives adjacent to each other can be reduced by milling with the total collision energy being set to a predetermined value or more. The collision energy of milling can be calculated using the following formula (4):

$$P^*=(PtPW/K) \tag{4}$$

In the above formula (4), P* is the total collision energy (kJ/kg), P is the collision energy applied per unit time (kJ/(s·kg)), t is the milling time (s), PW is the weight (kg) of the powder, and K is the relative rotational speed (rotation speed-revolution speed) (rpm) of a pot.

The total collision energy of milling is preferably 1500 kJ/kg or more and 5000 kJ/kg or less. By setting the total collision energy of milling to 1500 kJ/kg or more, the interval between adjacent additives can be reduced and the dispersibility of dispersions in the produced aluminum based composite material can be improved. Further, by setting the total collision energy of milling to 5000 kJ/kg or less, deterioration of the aluminum based composite material due to milling can be reduced. The total collision energy of milling is more preferably 2000 kJ/kg or more and 4000 kJ/kg or less.

The rotation and revolution speeds of milling are preferably, for example, 200 rpm to 250 rpm. Further, the rotation time of milling is preferably five minutes to 10 minutes. The amount of powder is 380 g to 800 g, and it is preferable that about 3 kg of zirconia balls with a diameter of 5 mm to 10 mm imparting impact energy are enclosed. By setting the milling conditions within the above range, the total collision energy of the milling can be set to the optimum range.

Next, a green compact is produced by compacting the mixed aluminum powder and additives. In the compacting process, the mixed powder is compressed by applying pressure thereto to prepare a green compact. In the compacting process, the mixed powder is preferably compressed in such a way that the gap between the aluminum powder and additives in the mixed powder is minimized.

As a method of applying pressure to the mixed powder in the compacting process of a green compact, a known method can be used. For example, a method can be cited by which mixed powder is input into a tubular compacting container and then the mixed powder in the container is pressurized. The pressure to be applied to the mixed powder is not particularly limited, and it is preferable to appropriately adjust the pressure so that the interval between the aluminum powder and additives is minimized. When the interval between adjacent additives in the mixing process is set to 300 nm or less, the interval between adjacent dispersions in the aluminum based composite material in the compacting process can be made to be 210 nm or less.

The pressure to be applied to the mixed powder can be, for example, 400 MPa to 600 MPa at which the aluminum powder can be compacted satisfactorily. Further, the process of applying pressure to the mixed powder in the compacting process can be performed, for example, at room temperature. Further, the time during which the pressure is applied to the mixed powder in the compacting process can be, for example, five seconds to 60 seconds.

Next, by sintering the obtained green compact, a portion or all of the additives are made to react with aluminum in the aluminum powder, so as to disperse the dispersions formed of aluminum carbide inside the aluminum parent phase. In the sintering process, it is necessary for the aluminum powder and additives to react to form the dispersions and thus, the sintering temperature of the green compact is set to 600° C. or higher. If the sintering temperature is lower than 600° C., the bonding reaction between the aluminum powder and additives does not proceed sufficiently, and the strength of the resultant aluminum based composite material may be insufficient. The upper limit of the sintering temperature is not particularly limited, but is preferably set to 660° C., which is the melting temperature of aluminum, or lower and more preferably 630° C. or lower.

The sintering time of the green compact is not particularly limited and is preferably set to a time needed for the aluminum powder and additives to react. More specifically, the sintering time of the green compact is preferably set to, for example, 0.5 hours to five hours. In addition, regarding the sintering atmosphere of the green compact, the green compact needs to be sintered under an inert atmosphere such as vacuum in order to suppress the oxidation of the aluminum powder and additives.

By performing such a sintering process, an aluminum based composite material in which dispersions are dispersed in the aluminum parent phase can be obtained. In order to make the obtained aluminum based composite material easier to process, it is preferable to extrude the sintered body obtained in the sintering process. By extruding the sintered body, a bar, a plate or the like can be obtained.

The method of extruding the sintered body is not particularly limited and any known method can be used. For example, a method in which a sintered body is put into a cylindrical extrusion apparatus and then the sintered body is heated and extruded can be cited. The sintered body is preferably heated to 300° C. or higher at which the sintered body can be extruded. By performing such an extrusion process, solid materials for rough drawing and plate material can be obtained.

In the manufacturing method according to the present embodiment, the average particle diameter (D50) of aluminum powder is preferably 20 μm or more. Even if the average particle diameter of the aluminum powder is less than 20 μm, it is possible to increase the strength of the resulting aluminum based composite material. However, when the average particle diameter is less than 20 μm, the amount of oxygen on the surface of aluminum powder increases and the conductivity may decrease. That is, aluminum reacts with oxygen in the air and a dense oxide film is formed on the surface and thus, the conductivity may decrease.

Figure 5:
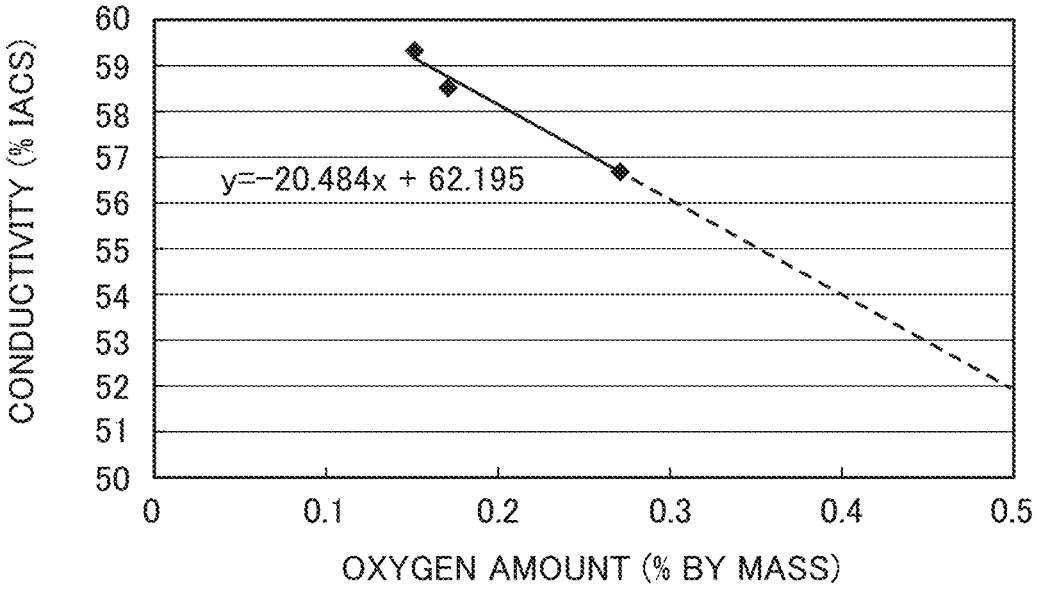
FIG. 5 is a graph showing the relationship between the conductivity of aluminum and the amount of oxygen contained in aluminum.
Figure 6:
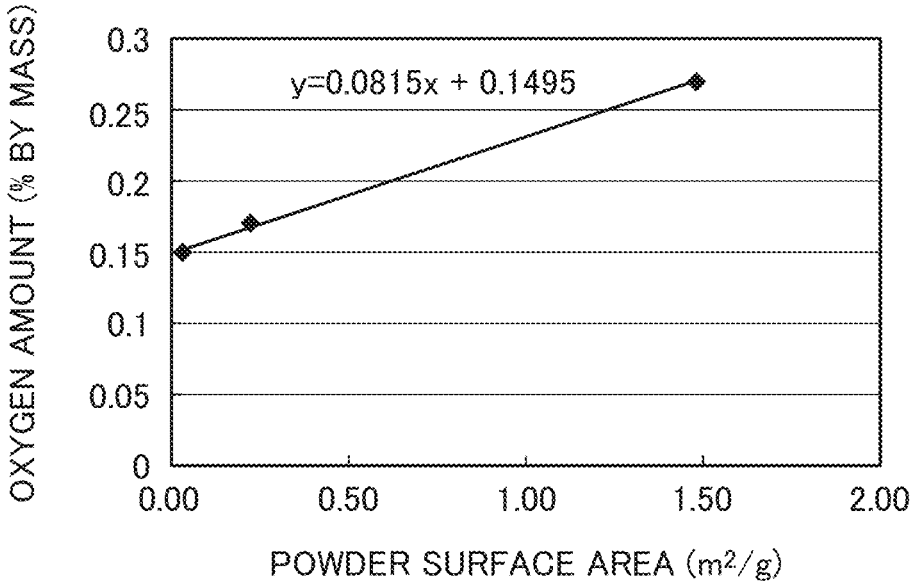
FIG. 6 is a graph showing the relationship between the amount of oxygen contained in aluminum and a surface area of aluminum powder.

FIG. 5 shows the relationship between the conductivity of aluminum and the amount of oxygen contained in aluminum. In addition, FIG. 6 shows the relationship between the amount of oxygen contained in aluminum and the surface area of the aluminum powder. To adjust an aluminum based composite materials to, for example, JASO D 603, the conductivity is required to be 58% IACS or more. Thus, from FIG. 5, the amount of oxygen contained in aluminum is preferably 0.21% by mass or less. Then, from FIG. 6, to make the amount of oxygen contained in aluminum equal to 0.21% by mass or less, it is preferable to set the specific surface area of aluminum powder to 0.75 $m^2/g$ or less. Therefore, to make the specific surface area of aluminum powder equal to 0.75 $m^2/g$ or less, the average powder diameter of aluminum powder is preferably 0.75 μm or more in calculation on the assumption that the aluminum powder maintains the spherical shape.

The assumption that the shape of the aluminum powder is substantially spherical means that the aspect ratio of the aluminum powder is within the range of 1 to 2. In the present specification, the aspect ratio is a value representing the shape of a particle defined by (maximum long diameter/width orthogonal to the maximum long diameter) in a microscopic image of the particle.

When the shape of the aluminum powder is flat, the surface area is increased by thinning the aluminum powder so that the dispersion degree of dispersions on the powder surface can be improved. More specifically, if the spherical powder having a powder diameter of 20 μm is processed into a flat shape having a thickness of 1 μm and a long diameter of 72 μm, the powder in the flat shape has a surface area equivalent to that of a spherical powder having a powder diameter of 3 μm. Therefore, when the shape of the aluminum powder is flat, the upper limit of the average powder diameter of aluminum powder is not particularly limited. Note that "the shape of the aluminum powder is flat" means that the ratio of the maximum long diameter to the thickness of the aluminum powder (maximum long diameter/thickness) is within the range of 10 to 100. The average powder diameter, the maximum long diameter, and the width and thickness orthogonal to the maximum long diameter of the aluminum powder can be measured by observation under a scanning electron microscope (SEM).

The method of processing the aluminum powder into a flat shape is not particularly limited and a known method can be used. For example, a flat aluminum powder can be obtained by inputting balls with a diameter of 5 mm to 10 mm, aluminum powder and additives into a pot of a planetary ball mill and subjecting the mixture to a rotation process.

As described above, the manufacturing method of an aluminum based composite material according to the present embodiment includes a step of mixing an aluminum powder having the purity of 99% by mass or more with the additives to obtain a mixed powder in which the interval between additives adjacent to each other is 300 nm or less. The manufacturing method of an aluminum based composite material includes a step of preparing a green compact by compacting a mixed powder. The manufacturing method of an aluminum based composite material includes a step of heating the green compact at a temperature of 600 to 660° C. to react a portion or all of the additives with aluminum in the aluminum powder, so as to disperse dispersions formed of aluminum carbide inside the aluminum parent phase. Therefore, according to the manufacturing method of the present embodiment, the aluminum based composite material having high strength and good conductivity can be provided.

EXAMPLES

Hereinafter, the present invention will be described in more detail with reference to examples and comparative examples, but the present invention is not limited to these examples.

Example 1

First, 396 g of pure aluminum powder and 1.99 g of carbon nanotube (CNT) were weighed so that the content of the obtained dispersion was 0.5% by mass in terms of carbon amount. The pure aluminum powder and carbon nanotubes used are as follows:

(Aluminum Powder)

"#260S" manufactured by Minalco Ltd.

Particle size: 75 μm or less (screening by the Ro-tap method)

(Carbon Nanotube)

Manufactured by CNano Technology Limited, product name: Flotube 9100

Average diameter: 10 to 15 nm

Average length: 10 μm

Average particle diameter (D50): 20 nm

Next, the weighed aluminum powder and carbon nanotubes were input into the pot of a planetary ball mill, and the mixed powder was prepared by milling through a rotating process. As the planetary ball mill, "SKF-04" manufactured by Seishin Engineering Co., Ltd. was used.

Milling was also adjusted so that the collision energy applied per unit time was 5 kJ/(s·kg) and the total collision energy was 3015 kJ/kg. In the present example, sufficient collision energy was given in the mixing process of the aluminum powder and carbon nanotubes so that the aluminum powder was formed into a flattened shape.

Specific milling conditions were as follows:

Rotation speed: 250 rpm

Revolution speed: 250 rpm

Rotation time: 5 minutes

The cross section of the obtained mixed powder was observed under a scanning electron microscope (SEM), and the average interval between carbon nanotubes was 206 nm.

Further, the resultant mixed powder was input into a metal mold and a pressure of 600 MPa was applied at room temperature to prepare a green compact.

The obtained green compact was heated at 630° C. in a vacuum for 300 minutes by using an electric furnace to obtain an aluminum based composite material.

Example 2

A planetary ball milling was adjusted so that the collision energy applied per unit time was 2.6 kJ/(s·kg) and the total collision energy was 772 kJ/kg, and the pure aluminum powder and carbon nanotubes were milled.

Specific milling conditions were as follows:

Rotation speed: 120 rpm

Revolution speed: 120 rpm

Rotation time: 5 minutes

An aluminum based composite material was obtained in the same manner as in Example 1 except for the above. In the present example, since the collision energy was not sufficient in the mixing process of the aluminum powder and carbon nanotubes, the aluminum powder was not formed into a flattened shape.

When the cross section of the obtained mixed powder was observed under a scanning electron microscope (SEM), the average interval between carbon nanotubes was 356 nm.

[Evaluation]

Figure 7:
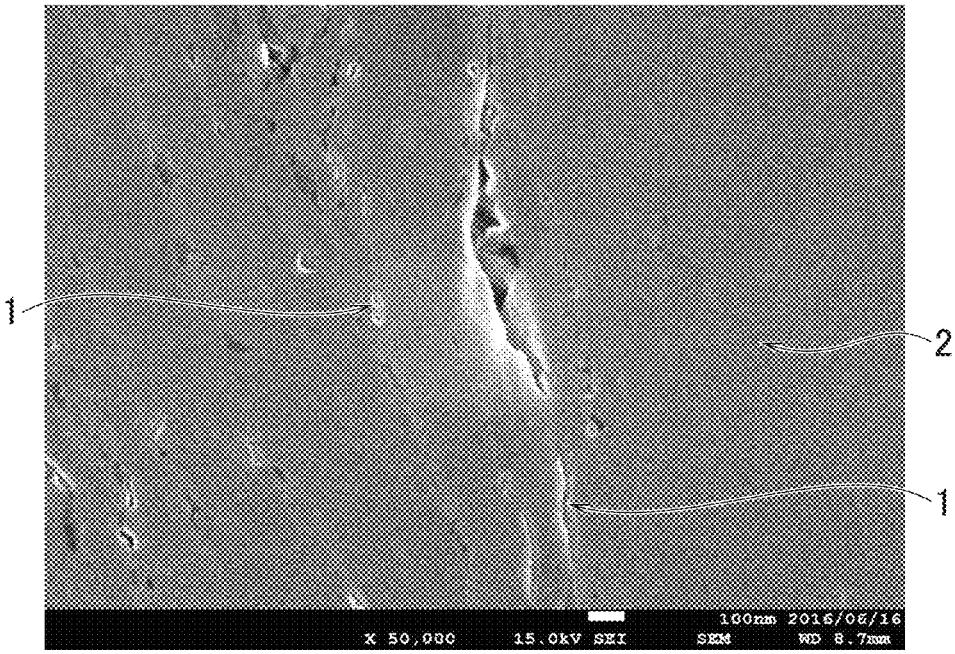
FIG. 7 is an electron micrograph of a cross section of Example 1.
Figure 8:
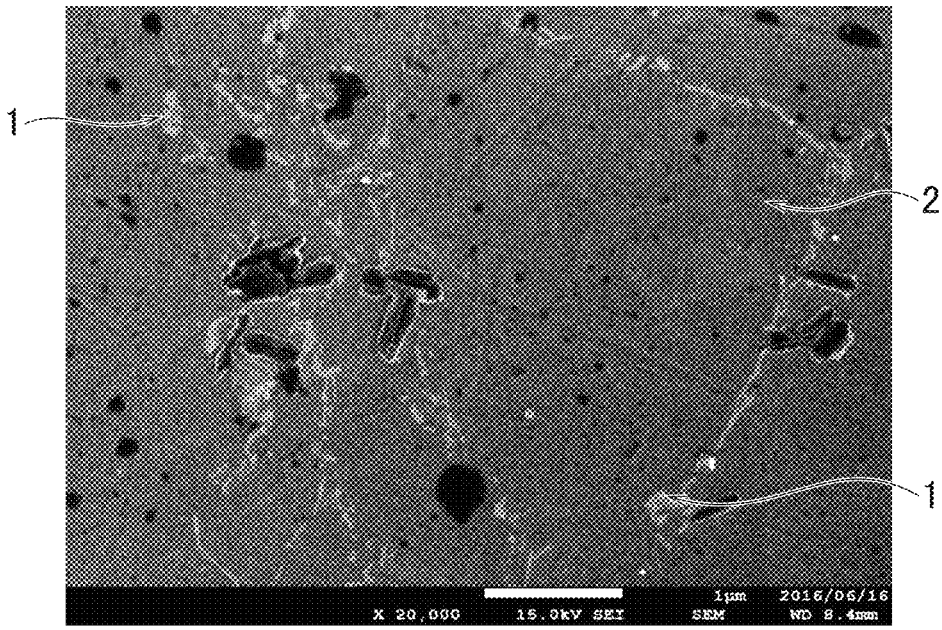
FIG. 8 is an electron micrograph of a cross section of Example 2.

The cross sections of the aluminum based composite materials of Example 1 and Example 2 were observed under a scanning electron microscope to measure the interval between carbon nanotubes. Also, the tensile strength and conductivity of the aluminum based composite materials of Example 1 and Example 2 were measured. The tensile strength was measured in accordance with JIS 22241. The conductivity was measured in accordance with JIS H 0505. These results are shown in Table 1. Further, electron micrographs of Example 1 and Example 2 are shown in FIGS. 7 and 8, respectively.

TABLE 1

| | Pure Al (mass %) | CNT (mass %) | Average particle diameter (nm) | Interval between CNT (nm) | Tensile strength (MPa) | Conductivity (% IACS) |
|---|---|---|---|---|---|---|
| Example 1 | 99.5 | 0.5 | 20 | 206 | 260 | 58.7 |
| Example 2 | | | | 356 | 223 | 59.2 |

Since the mixed powder of Example 1 was obtained by milling the aluminum powder and carbon nanotubes at a predetermined energy level or more, the carbon nanotubes could be incorporated into the inside of the aluminum powder. Therefore, the interval between carbon nanotubes was 206 μm on average so that the interval between the carbon nanotubes could be reduced to 210 nm or less.

On the other hand, since the mixed powder of Example 2 was obtained by milling the aluminum powder and carbon nanotubes at less than the predetermined level of energy, the carbon nanotube could not be incorporated into the inside of the aluminum powder. Thus, the interval between carbon nanotubes depends on the aluminum powder, the interval between the carbon nanotubes is 356 μm on average and so the interval between the carbon nanotubes could not be reduced to 210 nm or less.

As described above, by milling the aluminum powder and carbon nanotubes with high energy, the interval between the carbon nanotubes could be reduced to 210 nm or less and the carbon nanotubes could be highly dispersed in aluminum.

Here, the reinforcement mechanism of the aluminum-carbon nanotube composite material is greatly contributed by dispersion strengthening of carbon nanotubes and refinement of grains of carbon nanotubes. Then, by substituting arbitrary values into the Orowan-Ashby model formula represented by the above formula (2) and the formula (3) for the average particle diameter of the dispersions, the interval between adjacent dispersions and the amount of dispersions strengthening were calculated. In the present example, in the above formula (2), M is 3.1, G is 30 MPa, and b is 0.27 nm.

The results are shown in Table 2. The conductivity of the aluminum based composite material in each example shown in Table 2 was measured. The conductivity was measured in accordance with JIS H 0505. The pure aluminum powder having an average particle diameter of 20 μm was used, but since the powder was flattened to a thickness of 1 μm and a long diameter of 72 μm by milling, the specific surface area of the particle corresponds to an average particle diameter of 3 μm.

TABLE 2

| | Pure Al (mass %) | CNT (mass %) | Average particle size (nm) | Interval between CNT (nm) | Dispersion strengthening amount (MPa) | Conductivity (% IACS) |
|---|---|---|---|---|---|---|
| Example 3 | 99.75 | 0.25 | 1 | 10 | 441.18 | 59.7 |
| Example 4 | | | 10 | 99 | 126.18 | |
| Comparative Example 1 | | | 35 | 346 | 48.81 | |
| Comparative Example 2 | | | 100 | 998 | 20.82 | |
| Comparative Example 3 | | | 1000 | 9877 | 2.90 | |
| Example 5 | 99.5 | 0.5 | 1 | 7 | 586.74 | 58.8 |
| Example 6 | | | 10 | 74 | 167.81 | |
| Comparative Example 4 | | | 35 | 260 | 64.91 | |
| Comparative Example 5 | | | 100 | 743 | 27.70 | |
| Comparative Example 6 | | | 1000 | 7427 | 3.86 | |
| Comparative Example 7 | 99.25 | 0.75 | 1 | 6 | 698.88 | 57.9 |
| Comparative Example 8 | | | 10 | 62 | 199.89 | |
| Comparative Example 9 | | | 35 | 218 | 77.32 | |
| Comparative Example 10 | | | 100 | 624 | 32.99 | |
| Comparative Example 11 | | | 1000 | 6235 | 4.60 | |

As shown in Table 2, by setting the average particle diameter and content of the dispersions within the predetermined range, the interval between adjacent dispersions could be reduced to 210 nm or less. Then, such an aluminum based composite material was found to be excellent in strength and conductivity.

Though the present invention has been described by way of examples, the present invention is not limited to these examples, and various modifications can be made within the scope of the spirit of the present invention.

The invention claimed is:

1. An aluminum based composite material comprising an aluminum parent phase and dispersions dispersed in the aluminum parent phase and the dispersions are formed by at least a portion or all of additives reacting with aluminum in the aluminum parent phase, wherein an average particle diameter of the dispersions is 20 nm or less, a content of the dispersions is 0.25% by mass or more and 0.50% by mass or less in terms of carbon amount, an average interval between the dispersions adjacent to each other is 210 nm or less and is calculated from the average particle diameter and the content of the dispersions in a cross-section of the aluminum based composite material, and the aluminum based composite material has a conductivity of 58% IACS or more and a tensile strength of 250 MPa or more.

2. The aluminum based composite material according to claim 1, wherein the additives comprise at least one of carbon nanotubes, carbon nanohorns, carbon black, and boron carbide.

3. The aluminum based composite material according to claim 1, wherein the additives further comprise boron nitride.

4. An electric wire comprising the aluminum based composite material according to claim 1.

5. A manufacturing method of the aluminum based composite material according to claim 1, the method comprising:

mixing an aluminum powder having purity of 99% by mass or more with the additives to obtain a mixed powder in which an interval between the additives adjacent to each other is 300 nm or less;

preparing a green compact by compacting the mixed powder; and heating the green compact at a temperature of 600 to 660° C. to react a portion or all of the additives with aluminum in the aluminum powder, so as to disperse the dispersions formed of aluminum carbide inside the aluminum parent phase.

* * * * *